US010822823B2

(12) United States Patent
Schomburg et al.

(10) Patent No.: US 10,822,823 B2
(45) Date of Patent: Nov. 3, 2020

(54) PORTABLE RESTROOM

(71) Applicant: SATELLITE INDUSTRIES, INC., Minneapolis, MN (US)

(72) Inventors: Kenneth Schomburg, Plymouth, MN (US); Everett Spandl, Hopkins, MN (US)

(73) Assignee: Satellite Industries, Inc., Minneapolis, MN (US)

( * ) Notice: Subject to any disclaimer, the term of this patent is extended or adjusted under 35 U.S.C. 154(b) by 125 days.

(21) Appl. No.: 16/145,633

(22) Filed: Sep. 28, 2018

(65) Prior Publication Data

US 2019/0090698 A1 Mar. 28, 2019

Related U.S. Application Data

(60) Provisional application No. 62/565,057, filed on Sep. 28, 2017.

(51) Int. Cl.
*E04H 1/12* (2006.01)
*A47K 11/04* (2006.01)

(52) U.S. Cl.
CPC ..... *E04H 1/1216* (2013.01); *A47K 11/04* (2013.01)

(58) Field of Classification Search
CPC .... A47K 11/04; E04H 1/1216; E04H 1/00–14
USPC ..... 4/476–483
See application file for complete search history.

(56) References Cited

U.S. PATENT DOCUMENTS 2,793,401 A * 5/1957 Paschke ..... E04H 1/12 52/264
3,447,167 A * 6/1969 Harding ..... E04H 1/1216 4/462
3,521,417 A * 7/1970 Onjukka ..... E04H 1/12 52/282.3
4,065,885 A * 1/1978 Blick, III ..... E04H 1/1216 4/460
4,577,351 A * 3/1986 Harding ..... E04H 1/1216 4/460

(Continued)

OTHER PUBLICATIONS

The International Search Report and Written Opinion rendered by the International Searching Authority for PCT/US2018/053337, dated Dec. 3, 2018, 11 pages.

*Primary Examiner* — Patrick M. Buechner
(74) *Attorney, Agent, or Firm* — Skaar Ulbrich Macari, P.A.

(57) ABSTRACT

A portable restroom includes a thermoformed plastic floor panel that includes integral perimeter side wall portions that can be fastened directly to the side panels of a portable restroom. The top edge of the floor panel side wall portions extends outwardly to fit into a corresponding groove molded into the side panels of the restroom, in a tongue and groove fashion. This tongue and groove arrangement can be angled slightly upward so that the weight of the side panels helps to lock the two parts together. Fasteners further secure the floor panel to the side panels and are located around the perimeter of the floor just below the tongue and groove feature. The floor and side panels can be made of polyethylene plastic, formed by the thermoforming process. The vertical side walls of the molded floor can incorporate gusset features to add structure and rigidity to the floor panel.

19 Claims, 5 Drawing Sheets

(56) References Cited

U.S. PATENT DOCUMENTS 4,744,111 A * 5/1988 Tegg ..... E04B 1/34321 4/460
4,765,103 A * 8/1988 Clarke ..... E04B 1/3205 52/590.2
4,918,765 A * 4/1990 Harding ..... A47K 11/02 4/460
5,093,941 A 3/1992 Muller
D357,543 S * 4/1995 Holmstadt ..... E04H 1/1216 D25/138
5,682,622 A 11/1997 Tagg
5,724,774 A * 3/1998 Rooney ..... E04B 1/34321 52/79.5
6,115,971 A 9/2000 Loebertmann et al.
6,349,426 B1 * 2/2002 Wieringa ..... A47K 11/02 4/449
6,418,672 B1 * 7/2002 Hampel ..... E04H 1/1216 4/460
6,427,256 B1 * 8/2002 Mullett ..... A47K 11/02 4/476
6,438,902 B1 * 8/2002 Muller ..... E04H 1/1216 4/460
6,509,084 B2 1/2003 Sturtevant
9,765,542 B1 * 9/2017 Broughton ..... A47K 11/02
10,066,409 B2 9/2018 Sansom, III et al.
2003/0140571 A1 7/2003 Muha et al.
2004/0101357 A1 * 5/2004 Dijkstra ..... B65D 7/24 403/403
2007/0039260 A1 * 2/2007 Haddad ..... E04H 1/1216 52/241
2008/0209624 A1 9/2008 Lavoie et al.
2010/0212082 A1 8/2010 Tyler et al.
2014/0143945 A1 * 5/2014 Chen ..... E03D 7/00 4/321
2015/0272407 A1 * 10/2015 Weir ..... E04H 1/1216 4/476
2018/0016805 A1 * 1/2018 Sansom, III ..... E04H 1/1216

* cited by examiner

PORTABLE RESTROOM

PRIORITY

This application claims the priority benefit of U.S. Provisional Application No. 62/565,057, filed on Sep. 28, 2017, which is hereby incorporated herein by reference in its entirety.

FIELD

The present invention relates generally to portable restrooms, and more particularly to portable restrooms with easy access for wheelchairs.

BACKGROUND

Standard portable restrooms, such as that disclosed in U.S. Pat. No. 7,975,325, which is hereby incorporated by reference herein in its entirety, are mounted on a skid-type base. This makes the restrooms easy to move about and fasten the walls to, but the floor of the restroom is raised above the ground to a degree that a wheelchair could not enter the restroom even if the restroom were sufficiently large to accommodate a wheelchair. Therefore restrooms for accommodating persons in wheelchairs typically have a flat floor that sits on the ground so that the wheelchair can roll over the negligible edge of the floor member.

The conventional method for fastening walls to a flat plastic sheet floor to form a large (handicap/wheelchair accessible) portable restroom is to use several right-angle metal or plastic brackets, riveted to both the floor and the side walls as shown in U.S. Pat. No. 6,115,971, which is hereby incorporated by reference herein in its entirety. This method of assembly is labor intensive, time consuming, and strenuous. The multiple brackets and numerous rivets add cost to the price-sensitive restroom. The riveted connections also do not stand up well to rough handling of the restroom. These connections can be ripped apart as one restroom is pushed against another, or when the restroom is hit by a forklift. The flat sheet floor also makes it difficult to get underneath the restroom with the forks of a forklift. Sometimes the forks will jump up on top of the floor, as the forklift driver is moving forward, and shear off the brackets.

The rivets going through the brackets into the floor in conventional practice also require counterbored holes on the bottom of the floor panel to recess the necessary backup washers. These counterbored holes add cost to the manufacture of the floor, and they make it more difficult to slide the restroom across certain surfaces such as an expanded metal sheet. The assembly of this type of floor also requires that the floor be placed up on a work surface while one assembler positions the backup washer from underneath, and another assembler installs the rivet from above. One restroom may require 30 or more such rivets to be installed.

The flat-sheet floor has very little rigidity by itself. The brackets provide a great deal of rigidity for the restroom, but the points on the floor between neighboring bracket pieces are still allowed to flex considerably. A restroom that easily flexes and bends as it is moved around is viewed by the service personnel as a lower quality product.

Therefore, there is a continuing need to overcome the disadvantages of the conventional wheelchair accessible restrooms as completely as possible.

SUMMARY

The present invention provides an improved portable restroom that includes a thermoformed plastic floor panel (also referred to as a base) that includes integral perimeter side wall portions that can be fastened directly to the side panels of a portable restroom. The top edge of the floor panel side wall portions extends outwardly to fit into a corresponding groove molded into the side panels of the restroom, in a tongue and groove fashion. This tongue and groove arrangement can be angled slightly upward so that the weight of the side panels helps to lock the two parts together. Rivets or other fasteners further secure the floor panel to the side panels and are located around the perimeter of the floor just below the tongue and groove feature. The floor and side panels can be made of polyethylene plastic, formed by the thermoforming process. The vertical side walls of the molded floor can incorporate gusset features to add structure and rigidity to the floor panel. The threshold at the door opening can be chamfered to create a smoother entry and exit for wheelchairs.

The disclosure further includes a portable restroom that includes one or several wall panels, a roof disposed atop the wall panel and a base secured to the wall panel that defines a floor of the portable restroom. The base can include a planar upper surface portion with a perimeter side wall extending upward around a majority of a perimeter of the planar upper surface. A threshold portion is defined where there is no perimeter side wall. A top edge portion of the perimeter side wall extends outward from the perimeter of the planar upper surface to define a tongue portion. The wall panel includes a groove defined into an inner side thereof and which is configured and located such that the tongue portion of the base engages the groove when the wall panel is arranged such that the wall panel is disposed along the exterior of the perimeter side wall.

A plurality of fasteners can be provided to further secure the wall panel and base together. The fasteners can extend through the wall panel and the perimeter side wall of the base. Each fastener is located vertically below the tongue portion.

The disclosure also includes a base for a portable restroom. The base includes a planar upper surface portion, a perimeter side wall extending upward around a majority of a perimeter of the planar upper surface portion, and a threshold portion defined where there is no perimeter side wall. A top edge portion of the perimeter side wall extends outward from the perimeter of the planar upper surface to define a tongue portion.

The width dimension of the threshold can be sufficiently large to permit standard wheelchairs to roll onto the planar upper portion without contacting the perimeter side wall. A forward edge of the planar upper surface portion of the base that spans the threshold can be chamfered.

The base can be formed as a single thermoformed polyethylene plastic component. The upper surface portion of the base can include a non-slip texture region. The upper surface portion of the base further can include a smooth region. The side wall can include a plurality of periodic gussets defined therein. An inner surface of the sidewall can be smooth.

A door can be pivotally mounted to a door frame. The door frame is joined together with the wall panel. The door includes an exterior door handle and a door lock.

The disclosure further includes a method of joining a wall panel to a base when assembling a portable restroom. The method includes disposing the wall panel along an exterior of a perimeter wall portion of the base while inserting an outwardly extending tongue portion of the perimeter wall portion into a groove defined into the wall panel.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
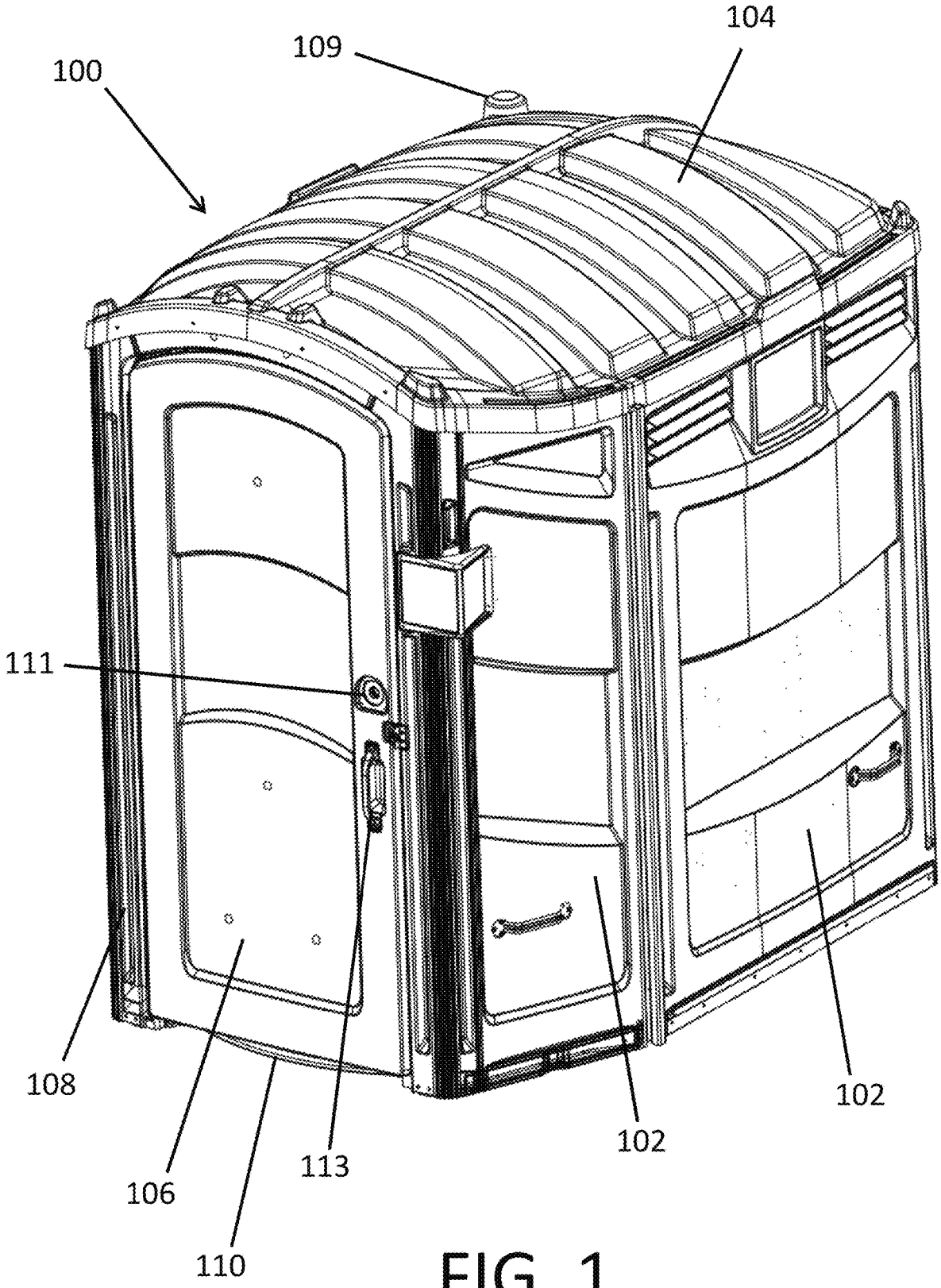
FIG. 1 is a perspective view of a portable restroom according to certain embodiments.
Figure 2:
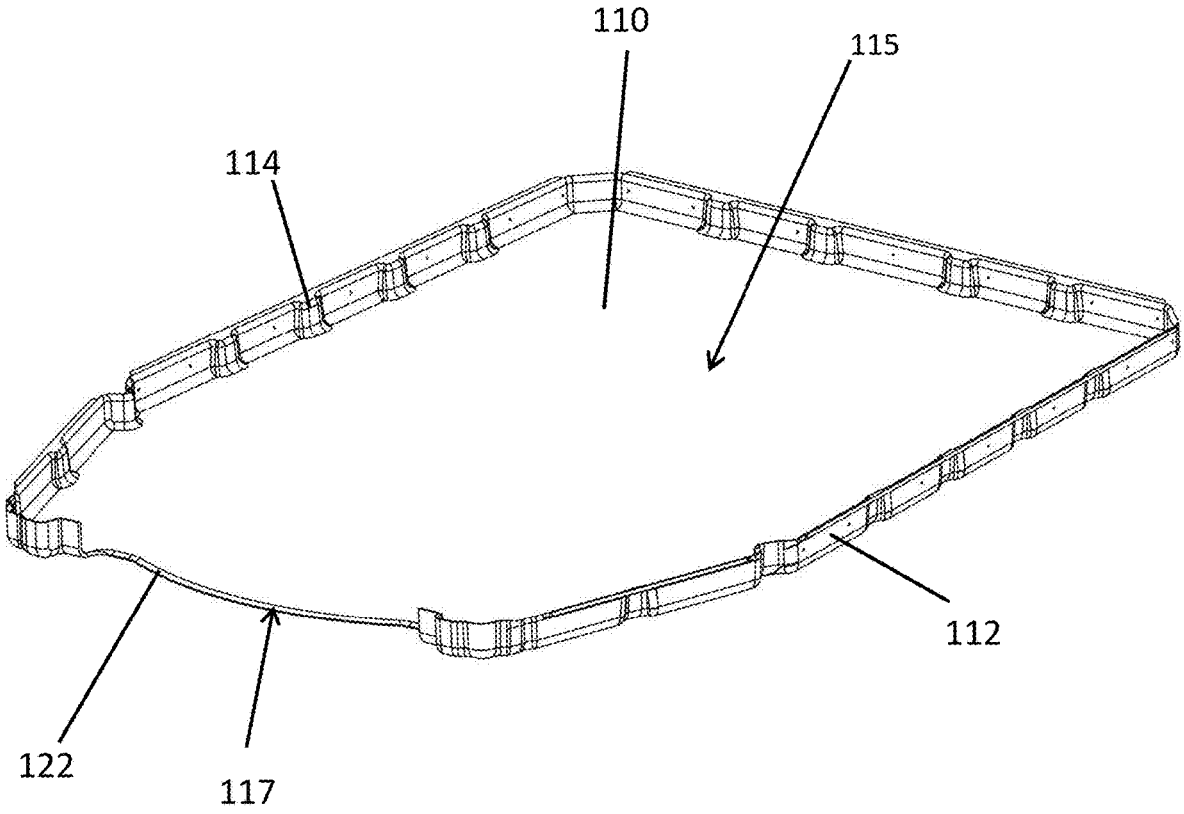
FIG. 2 is a perspective view of a base for a portable restroom according to certain embodiments.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION

In the following descriptions, the present invention will be explained with reference to various exemplary embodiments. Nevertheless, these embodiments are not intended to limit the present invention to any specific example, environment, application, or particular implementation described herein. Therefore, descriptions of these example embodiments are only provided for purpose of illustration rather than to limit the present invention.

Referring to FIG. 1, a portable restroom 100 according to certain embodiments includes a plurality of side panels 102 joinable together along a vertical edge of each. A roof 104 is disposed atop the side panels. A door 106 in a door frame 108 panel forms one of the side walls or is disposed in one of the side walls 102. The side walls 102 and door frame 108 are secured atop a floor panel 110.

The side panels 102, roof 104, door 106, door frame 108 and base 110 together define an enclosed interior of the restroom 100 that is accessible via the door 106. The respective components can be dimensioned such that a user can wheel a wheelchair through the door frame when the door is opened and then use the restroom while the wheelchair is inside of the restroom.

Conventional internal features such as a commode, waste tank, wash station, etc. can be provided inside of the restroom 100 enclosure. A vent 109 for the waste tank can exit through the roof 104.

A locking mechanism 111 and handle 113 can be provided to the door 106.

Referring to FIGS. 2-6, the base 110 is shown. The base 110 is also referred to as the floor panel. The base 110 defines planar or flat upper 115 and bottom surfaces. A perimeter side wall 112 rises vertically above the upper surface 115 for the majority of the perimeter of the base 110. The side wall 112 does not exist along the threshold 117 where the door 106 is provided to the assembled restroom 100 so that the door opening has proper clearance and so that wheels of a wheelchair can easily roll onto the flat upper surface 115 of the base 110. The threshold below the door opening can also be chamfered 122 to create a smoother entry and exit for wheelchairs.

A non-slip texture 123 can be molded into or provided on the upper surface 115 for enhanced safety. For example, a pattern formed of a plurality of raised dots or other shapes can be molded into the upper surface 115 of the base 110. A rubber over molding or application can alternatively be provided to the upper surface 115 of the base 110.

The side wall 112 includes periodic gussets 114 defined therein in order to enhance rigidity and maintain the vertical orientation of the side walls 112.

Figure 3:
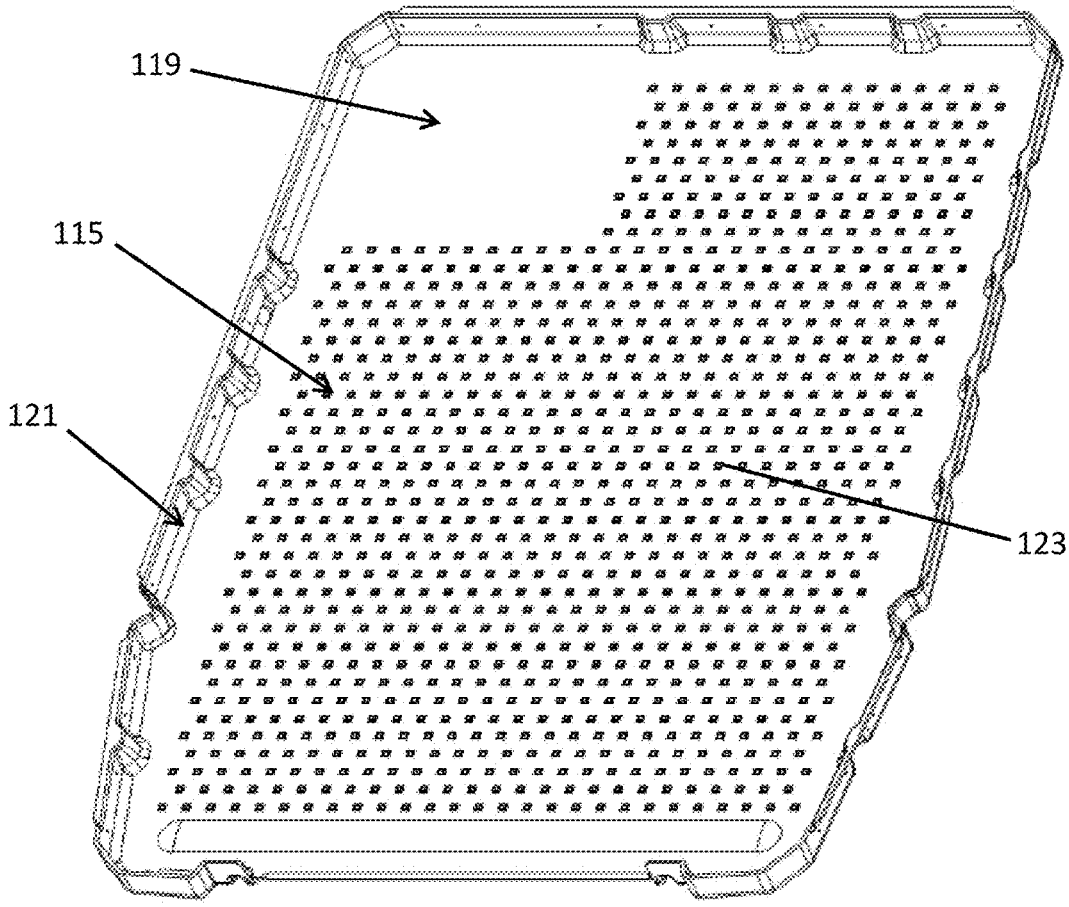
FIG. 3 is another perspective view of a base for a portable restroom according to certain embodiments.
Figure 4:
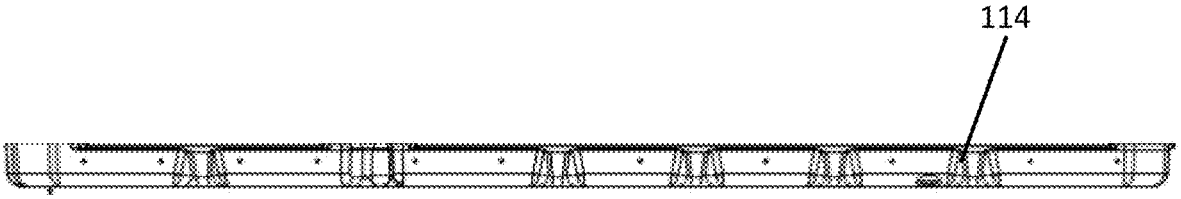
FIG. 4 is a side view of a base for a portable restroom according to certain embodiments.
Figure 5:
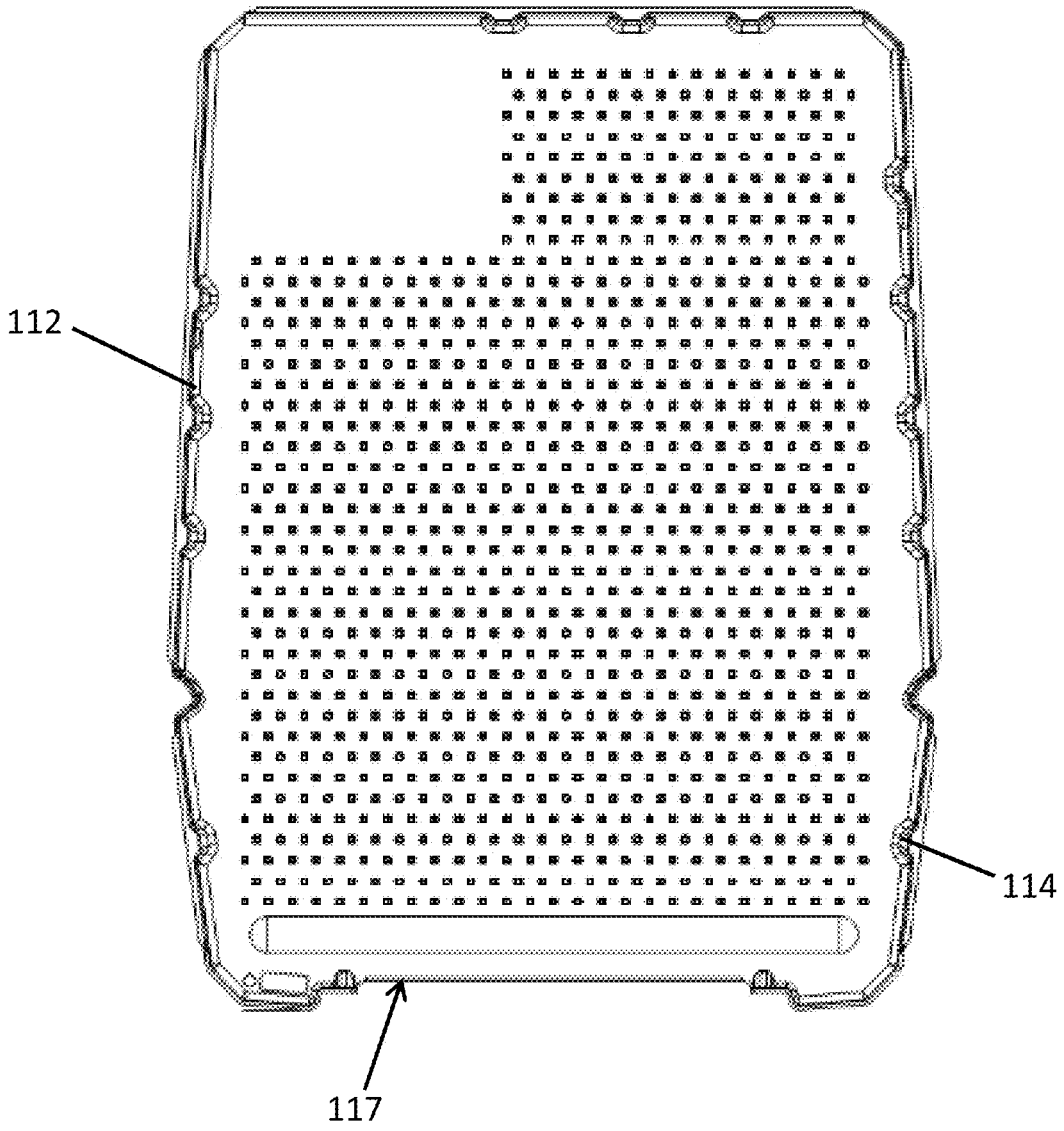
FIG. 5 is a top view of a base for a portable restroom according to certain embodiments.
Figure 6:
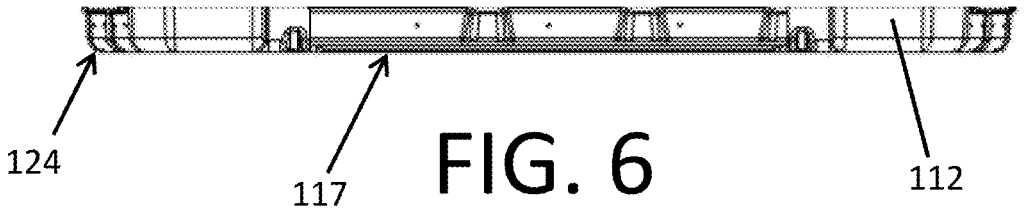
FIG. 6 is a front view of a base for a portable restroom according to certain embodiments.

The side wall's 112 inner corner surface 121 is radiused and is not textured so that it is easier to clean. Also, the texture can be omitted on a portion 119 of the upper surface 115 of the base 110, as shown in FIGS. 3 and 5, so that the waste tank can sit securely atop the base 110. Typically the user's seat is mounted on top of the waste tank.

The bottom side of the floor panel 110 is not shown, but can also be provided with a textured surface or other non-slip features to reduce the chance for slippage along the ground where the restroom is placed.

Figure 7:
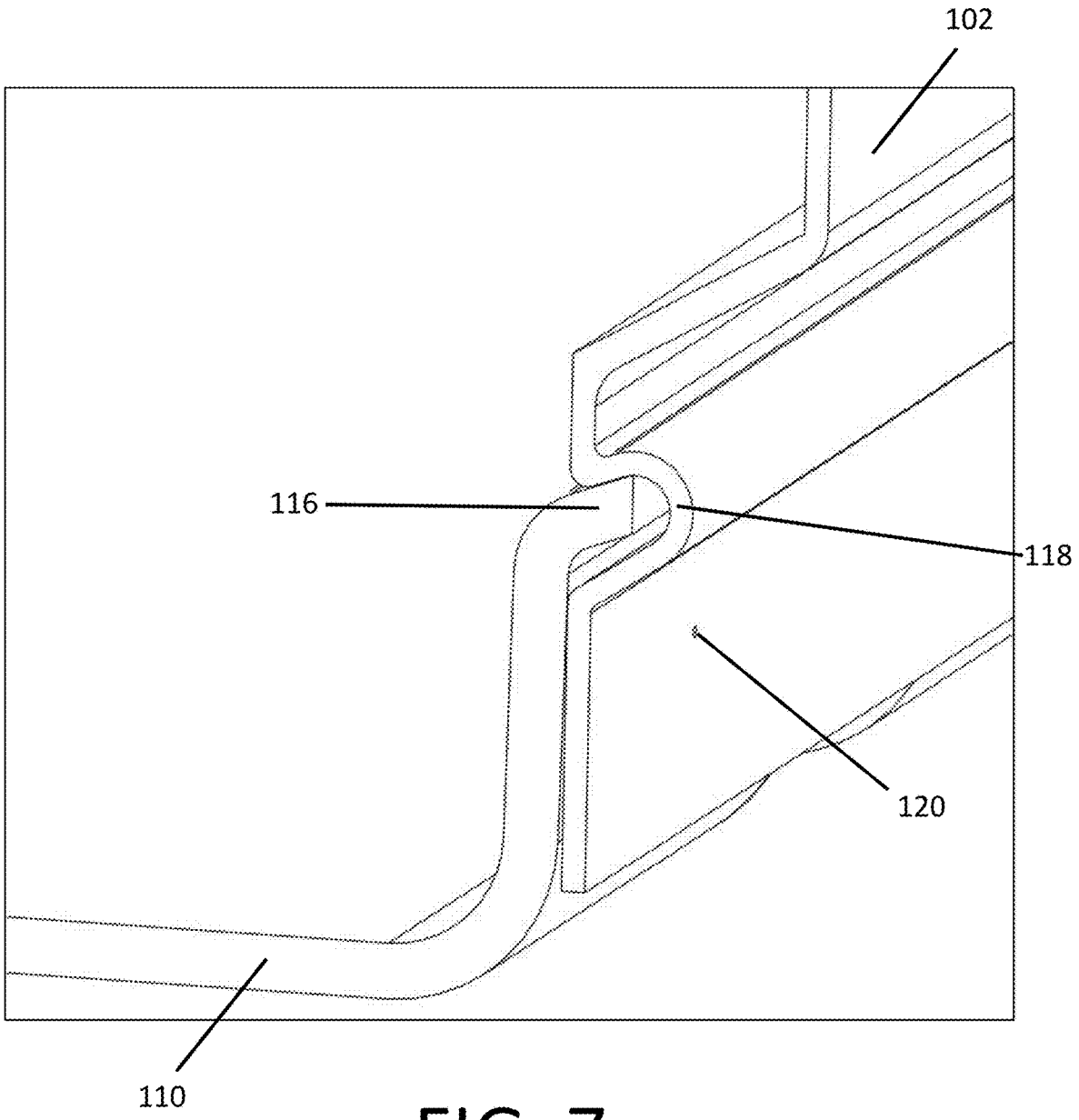
FIG. 7 is a detailed perspective view of a portion of a portable restroom showing joining of the side panel to the base according to certain embodiments.

Referring to FIG. 7, the top edge of the side walls 112 can be flared or curved outward to form a tongue 116 portion that engages a corresponding groove or recess 118 defined into the side panels 102. This type of tongue and groove engagement of the side wall 112 of the base 110 with the side panels 102 helps to better support the side panels 102 and lessens the stress on the rivets 120 or other fasteners used to attach the side panels 102 to the base 110.

The side panels 102 can be fastened to the base 110 using fastening hardware such as rivets 120, screws and nuts, plastic rivets, metal or plastic clips, etc. The fastening can also be via adhesives or plastic welding. A combination of fastening techniques can also be employed.

Only a small protruding portion of the base 110 is seen under the door 106 in FIG. 1 because side panels 102 extend over the outside of the floor panel sidewall 112. In other words, the side walls 112 of the base 110 are disposed or located inside of the side panels 102 so that they are not visible external to the enclosure. This arrangement is advantageous because rain will run down to the ground along the exterior side of the side panels 102 instead of entering the enclosure via an interface seam between the side panels and the base's sidewall if the side panels were fastened internal to the base's sidewalls.

The present fastening arrangement of the side walls 112 of the base 110 located inside of the side panels 102 also presents a much cleaner exterior look to the assembled restroom 100.

The base or floor panel 110 can be formed as a single thermoformed polyethylene plastic component. Other materials and processes may be used to achieve similar results, such as: blow-molded plastic, injection-molded plastic, rotationally molded plastic, polypropylene, ABS, stamped metal, etc.

The sheet from which the floor panel 110 is molded can also be coextruded such that it has two layers of plastic. The top, thinner layer can be colored grey, while the thicker bottom layer can be colored black. The black layer can use a lower-cost colorant and can contain recycled material. The top grey layer can be selected to provide a more desirable aesthetic, making dirt less conspicuous. The co-extruded sheet provides a nice looking, durable floor while minimizing cost.

The side panels 102 and roof 104 can be formed from polyethylene (or other plastic) sheet. The side panels 102 and roof 104 can also be twin-sheet thermoformed, blow-molded, or injection molded. The door 106 and door frame 108 can be made of sheet products or twin-sheet thermoformed, or blow-molded, or injection molded components.

The portable restroom 100 can include any of the features disclosed in published Patent Pub. No. 2017/0051486 A1, which is incorporated herein in its entirety.

Numerous benefits are provided by various aspects as discussed herein, including a reduction of the number of parts and number of rivets needed to build the restroom. This reduces assembly time and may reduce part costs. Molding the base 110 with a non-slip texture 123 only where needed provides an easy to clean, smooth upper surface 115 along the edges and side walls 112.

The side panels 102 and base 110 lock or interlock together with a tongue and groove feature for a secure engagement. The tongue portion 116 is sloped upward so that the weight of the side panel 102 forces the panel to stay locked on the base 110. This arrangement also removes much of the weight of the wall from the fasteners.

The base 110 configuration eliminates the need for fasteners going down through the floor and requiring counterbored holes on the underside of the base 110. This elimination removes some cost of secondary operations on the base, and eases assembly. The restroom 100 can now be assembled without needing to lift the base 110 off the ground.

The radiused inner corner surface 121 of the base 110 is easier to clean around, compared to the corner formed by conventional right angle brackets bolted to a flat panel. The outer side radius 124 of the base 110 also makes it easier for forklift forks to get under the restroom to lift it as compared to a flat-sheet floor configuration.

The side walls 112 of the base 110 will not tear out as easily as conventional angle brackets, such as when struck by a fork lift or as a result of rough handling.

The gusset features 114 defined in the side walls 112 of the base 110 add strength and rigidity to the base and to the overall restroom 100 as compared to a smooth side wall lacking such gussets.

Other features and aspects of the invention can be appreciated from the depictions in the figures, even if not described in writing herein.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. A portable restroom, comprising:

a wall panel;

a roof disposed atop the wall panel; and a base secured to the wall panel that defines a floor of the portable restroom, the base comprising a planar upper surface portion with a perimeter side wall extending upward around a majority of a perimeter of the planar upper surface and defining a threshold portion where there is no perimeter side wall, wherein a top edge portion of the perimeter side wall extends outward from the perimeter of the planar upper surface to define a tongue portion, and wherein the wall panel includes a groove defined into an inner side thereof and which is configured and located such that the tongue portion of the base engages the groove when the wall panel is arranged such that the wall panel is disposed along the exterior of the perimeter side wall.

2. The portable restroom of claim 1, further comprising a plurality of fasteners extending through the wall panel and the perimeter side wall of the base, each fastener located vertically below the tongue portion.

3. The portable restroom of claim 1, comprising a plurality of wall panels.

4. The portable restroom of claim 1, wherein the threshold has a width dimension sufficiently large to permit standard wheelchairs to roll onto the planar upper portion without contacting the perimeter side wall.

5. The portable restroom of claim 1, wherein the base is formed as a single thermoformed polyethylene plastic component.

6. The portable restroom of claim 1, wherein a forward edge of the planar upper surface portion of the base that spans the threshold is chamfered.

7. The portable restroom of claim 1, wherein the upper surface portion of the base includes a non-slip texture region.

8. The portable restroom of claim 7, wherein the upper surface portion of the base further includes a smooth region.

9. The portable restroom of claim 1, wherein the side wall includes a plurality of periodic gussets defined therein.

10. The portable restroom of claim 1, wherein an inner surface of the sidewall is smooth.

11. The portable restroom of claim 1, further comprising a door pivotally mounted to a door frame, the door frame joined together with the wall panel and the base, wherein the door includes an exterior door handle and a door lock.

12. A base for a portable restroom, comprising:

a planar upper surface portion;

a perimeter side wall extending upward around a majority of a perimeter of the planar upper surface portion; and a threshold portion defined where there is no perimeter side wall, wherein a top edge portion of the perimeter side wall extends outward from the perimeter of the planar upper surface to define a tongue portion.

13. The base of claim 12, wherein the threshold has a width dimension sufficiently large to permit standard wheelchairs to roll onto the planar upper portion without contacting the perimeter side wall.

14. The base of claim 12, wherein the base is formed as a single thermoformed polyethylene plastic component.

15. The base of claim 12, wherein a forward edge of the planar upper surface portion of the base that spans the threshold is chamfered.

16. The base of claim 12, wherein the upper surface portion includes a non-slip texture region.

17. The portable restroom of claim 12, wherein the upper surface portion includes a smooth region.

18. The portable restroom of claim 12, wherein the side wall includes a plurality of periodic gussets defined therein.

19. The portable restroom of claim 12, wherein an inner surface of the sidewall is smooth.

* * * * *